US011453214B2

(12) United States Patent
Franck

(10) Patent No.: US 11,453,214 B2
(45) Date of Patent: Sep. 27, 2022

(54) PRINTING METHOD FOR A DIGITAL PRINTING DEVICE

(71) Applicant: Jan Franck, Weidenberg (DE)

(72) Inventor: Jan Franck, Weidenberg (DE)

( * ) Notice: Subject to any disclaimer, the term of this patent is extended or adjusted under 35 U.S.C. 154(b) by 0 days.

(21) Appl. No.: 16/767,193

(22) PCT Filed: Dec. 4, 2018

(86) PCT No.: PCT/IB2018/059616
§ 371 (c)(1),
(2) Date: May 27, 2020

(87) PCT Pub. No.: WO2019/111147
PCT Pub. Date: Jun. 13, 2019

(65) Prior Publication Data

US 2020/0391506 A1 Dec. 17, 2020

(30) Foreign Application Priority Data

Dec. 5, 2017 (DE) ..... 10 2017 011 197.9

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04593; B41J 2/04588; B41J 2/04581; B41J 2/04541
See application file for complete search history.

(56) References Cited

U.S. PATENT DOCUMENTS

2009/0184995 A1 7/2009 Usui
2011/0102486 A1 5/2011 Tabata et al.
(Continued)

FOREIGN PATENT DOCUMENTS

JP 2012045797 3/2012

*Primary Examiner* — Lam S Nguyen
(74) *Attorney, Agent, or Firm* — Pandiscio & Pandiscio, P.C.

(57) ABSTRACT

The invention relates to a printing method for a digital printing device, comprising a print head having a plurality of printing systems and comprising at least one control apparatus for feeding control signals to the printing systems for the production of ink drops. Each printing system has a nozzle, at least one ink chamber and an activator, e.g. a piezoelectric activator, which is associated with the at least one ink chamber, for the discharge of ink drops from the ink chamber in question via the nozzle in question onto a substrate to be printed on, as a response to a control signal. In the control apparatus, only a single waveform for the control signal having a specified time curve is stored for ink drops of all sizes, comprising, for example, optionally an initial waiting time, a first edge, followed by a first holding time, and, after the first holding time, a second, opposite edge, optionally followed by a second holding time. The size and/or speed of ink drops is varied by virtue of the fact that, at most for a single, intrinsic drop size, the entire stored waveform is transferred as a control signal to the activator in question, while for all other, effective drop sizes, only part of the common, stored waveform is transferred to the activator in question, namely one or more selected portions, while one or more other portions of the stored, common waveform are not supplied to the activator in question in the control signal.

29 Claims, 7 Drawing Sheets

(56) References Cited

U.S. PATENT DOCUMENTS

| | | | |
|---|---|---|---|
| 2012/0293577 | A1 | 11/2012 | Kyoso et al. |
| 2013/0083106 | A1 | 4/2013 | Tsukamoto |
| 2016/0039201 | A1 | 2/2016 | Zhang |

Fig.3
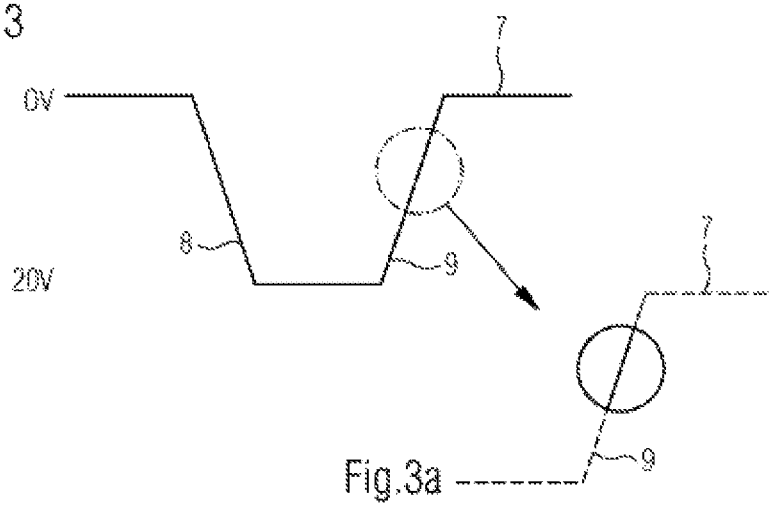
Fig.3a
Fig.4
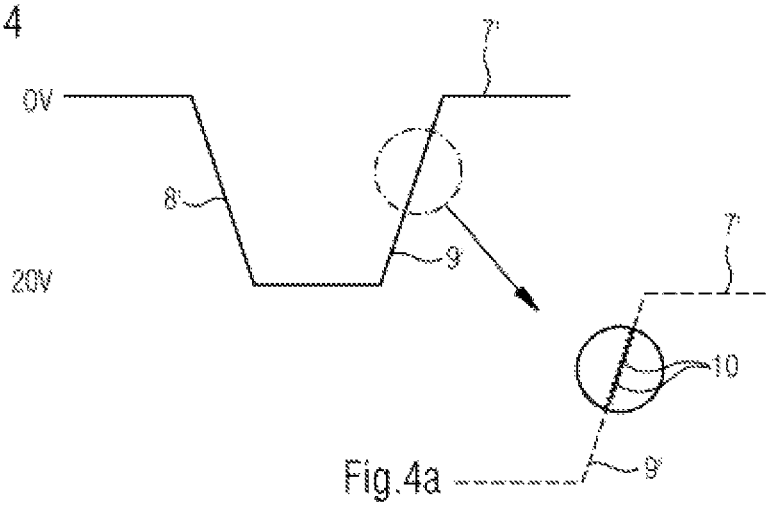
Fig.4a

PRINTING METHOD FOR A DIGITAL PRINTING DEVICE

REFERENCE TO PENDING PRIOR PATENT APPLICATION

This patent application claims benefit of International (PCT) Patent Application No. PCT/IB2018/059616, filed 4 Dec. 2018 by Jan Franck for PRINTING METHOD FOR A DIGITAL PRINTING DEVICE, which claims benefit of German Patent Application No. DE 10 2017 011 197.9, filed 5 Dec. 2017, which patent applications are hereby incorporated herein by reference.

FIELD OF THE INVENTION

The invention relates to a printing method for a digital printing device, comprising a print head having a plurality of printing systems and comprising at least one control apparatus for feeding control signals to the printing systems for the production of ink drops, wherein each printing system has a nozzle, at least one ink chamber and an activator, e.g. a piezoelectric activator, which is associated with the at least one ink chamber, for the discharge of ink drops from the ink chamber in question via the nozzle in question onto a substrate to be printed on, as a response to a control signal.

BACKGROUND OF THE INVENTION

As an indirect or analog printing method, offset printing is one of the most widespread printing technologies for printing books, newspapers, advertising and packaging. Prior to printing, first of all an individual printing plate is fabricated, from which the ink is then transferred to a rubber cylinder during the printing process and from there subsequently to the substrate to be printed on. A separate printing plate is required for every design and every color. The comparatively high quality of offset printing is produced by a comparatively low resolution, e.g., 150 lpi or 120 lpi (grid of 150 grid dots or 120 grid dots pro square inch), for which, however, an almost infinite number of different dot sizes are available for every dot. Thus, with a predetermined grid size, the color intensity from white to e.g., 100% magenta can be realized just by increasing the size of the ink dots.

On the other hand, in the case of digital printing, a printing plate is dispensed with and the printed image is in fact transferred from a computer directly to the printing device. In this case, above all ink jet printing mechanisms or laser printers are considered printing devices. By dispensing with a printing plate, digital printing is simpler, faster and more cost-effective, especially also for smaller runs. In the case of common ink printers or inkjet printers that have piezo print heads, for example, printing is controlled either by an individual electrostatic charge of a continuous inkjet, which can then be deflected to a field depending on its electrical charge (continuous inkjet method or CIJ), or by discharging individual drops on demand (drop-on-demand method or DOD).

However, in most cases these types of digital printers have only 2 or 3 different drop sizes per printing ink, which correspond to the dot sizes in offset printing. While this is hardly noticeably when printing text or other black-and-white documents with a strong contrast between dark and light, inkjet printers are less suited for printing color photos or black-and-white photos with shades of gray. If, for this purpose, an attempt is made to divide every individual pixel into a smaller grid of 4 by 4 smaller dots, for example, and then print 0, 1, 2 . . . 15, 16 of these smaller grid dots, one can indeed already differentiate 16 different color intensities; however, these smaller brightness grid dots of a pixel can absolutely still be perceived by the eye as dots or in any case as visual turmoil, or even produce the so-called moiré effect, i.e., microscopic structures repeating regularly and thereby producing a clearly discernable or even conspicuous macroscopic pattern. In addition, breaking up a pixel into, for example, 16 small grid dots would reduce the printing speed dramatically, because now, instead of a single print pulse, 16 print pulses are required. Furthermore, one needs complex algorithms in order to suppress the aforementioned moiré effect as well as disadvantageous effects like that.

The goal of industry is a printing technology that makes use of the advantages of both printing technologies without their disadvantages. The requirements of this type of printing technology can be described as follows: The advantages of offset printing, specifically high quality with low resolution, high speed, stable printing over a long period of time, however, without the disadvantages of offset printing, i.e., the necessity of creating printing plates, but rather a digital control, for example, for the purpose of quickly changing designs, etc.

Even though many attempts have been made in this direction, problems have been encountered repeatedly, which can be described as follows in terms of the current prior art:

In order to achieve the quality of offset printing from a purely visual point of view, digital printing requires a much higher resolution as described above. A high printing speed with this type of high physical resolution requires a high number of print nozzles with a corresponding high density/resolution and a high firing frequency (1200 dpi=48 kHz/2400 dpi=96 kHz) and simultaneously very small drops (1 pl to 5 pl). In order to ensure high printing stability over a long period of time, systems are being built redundantly with "spare nozzles" for nozzles that don't print correctly and corresponding technical devices that identify such nozzles as defective and replace them accordingly.

For the mechanical engineer, this means a very high standard for mechanical components, above all with respect to the adjustment of print heads, which must be aligned perfectly with one another within a range of a few micrometers. At the same time, these machines require complex monitoring of the nozzles, e.g., in the form of visually detecting defective nozzles during printing and correspondingly replacing these nozzles. The entire material transport has to be adapted to digital printing, because air turbulence strongly deflects the small drops of 1 pl to 5 pl.

Both the software as well as the hardware must be able to send massive quantities of print data to the printer units, which must be prepared in advance for digital printing, similar to a RIP software. Because print data normally comes from the pre-print stage with a resolution of 150 to 300 dpi, wherein an exact color value is assigned to every pixel, for the print data this means the extrapolation or distortion of the image to 1200×1200 or 1200×2400 dpi. In the process, the pure file uncompressed already increases 16- to 32-fold. Added to this, are various algorithms, which, for one, mask the mechanical tolerances of the machine and, at the same time, must reflect the perfect printed image without identifiable effects for the human eye plus conventional color management for color fidelity, etc.

Manufacturing print heads with ever greater physical resolution (nozzle density) and ever smaller drops also causes problems for print head manufacturers. The smallest mechanical deviations in fabrication, and/or nozzles that do not function lead to enormous waste in production and to a correspondingly high final price of the print heads.

The work of ink manufacturers or print head electronics developers is just as involved.

An alternative approach for developing a printing machine having the aforementioned properties, i.e., high quality with low resolution, high speed, stable printing over a long period of time without using printing plates, would be to actuate a print head in such a way that, similar to offset, it prints one drop in the appropriate drop size for every pixel.

As a result, attempts have already been made to change the number of drops and/or the drop size with a nozzle size that remains the same.

The usual way of doing this is replicating the control pulses per pixel. Depending on the time interval in which these control pulses follow one another, either more drops are produced therewith, or larger drops, if the individual drops interconnect in the region of the nozzle or in flight. As a result, darker colors can be realized for each pixel, for example a darker gray all the way up to black. Reducing the drop size for the purpose of improving the graduations of gray is not possible with this however. Beyond this, a number of print pulses are necessary for such an increase in the number of drops or size of drops, whereby the printing speed suffers in turn. Apart from that, it turns out that larger ink drops typically have a higher speed than smaller ink drops, which can have an impact in the form of a non-uniform printed image.

SUMMARY OF THE INVENTION

Resulting from the disadvantages of the described prior art is the problem that initiated the invention of further developing a generic printing method for an inkjet print head such that the drop size and/or drop speed can be influenced or adjusted with the least possible effort. Of special interest is the question of whether different drop sizes are able to ensure a uniform drop speed.

The solution to this problem is achieved in that in the control apparatus, only a single waveform for the control signal having a specified time curve is stored for ink drops of all sizes, comprising, for example, optionally an initial waiting time, a first edge, followed by a first holding time, and, after the first holding time, a second, opposite edge, optionally followed by a second holding time, wherein the size and/or speed of ink drops is varied by virtue of the fact that, at most for a single, intrinsic drop size, the entire stored waveform is transferred as a control signal to the activator in question, while for all other, effective drop sizes, only part of the common, stored waveform is transferred to the activator in question, namely one or more selected portions, while one or more other portions of the stored, common waveform are not supplied to the activator in question in the control signal.

Preferably as a part of the control apparatus for the production of ink drops of a different size, a single waveform for the control signal having a specified time curve is stored for ink drops of all sizes in the form a single in print pulse, comprising a first edge for increasing the volume of an ink chamber by means of the activator in question, followed by a first holding time, during which the ink is suctioned into the ink chamber in question, as well as a second edge for reducing the volume of the ink chamber in question by means of the activator in question, followed by a second holding time, during which an ink drop is fired out of the associated nozzle, wherein the different drop size is achieved in that at most for a single drop size, the entire waveform is transferred as a control signal to the activator in question, while for all other drop sizes, one or more other portions of the stored, common waveform, comprised of a first edge, first holding time, second edge and second holding time, are not supplied to the activator in question in the control signal.

The inventor discovered that by also suppressing one or more segments of a saved, common waveform, it is possible to significantly and reliably have an impact on the drop size, i.e., it is possible to generate drops with considerably differing sizes, wherein the repeat accuracy is very precise, i.e., the different drop sizes are maintained with great precision. On the other hand, the individual suppression of individual segments of a saved, common waveform allows a more flexible influence on the drop size. For example, the deployment time point and the end time point for portions of the common waveform to be transferred can be influenced analogously, i.e., continuously, while in the case of different waveforms to be saved, the number of different drop sizes is countable. This advantage is also the result in particular of that fact that as a part of present method, whole pulses are not faded in or out, such as is used for example when printing several drops in order to change the number of drops, rather than individual time periods of an individual print pulse is faded out or in.

To actuate an activator, the invention recommends using a control stage with a switched output or preferably a control stage with a controlled or regulated output. In this connection, a switching should be understood as a switched output, which is able to switch back and forth on the output side between two or more predetermined, preferably constant voltages, i.e., for example between 0 V and 20 V. In such cases, an edge is not specified as a transition between these constant voltages, rather the output always follows, with the highest possible speed, the respective switched-through constant voltage value. In the case of a controlled or regulated output, several or, in an ideal case, even any number of intermediate voltages are possible.

It is within the scope of the invention that the control circuit is high-impedance during portions of the saved waveform that are not switched-through on the control output thereof that is connected to an activator. In this high-impedance state, the activator is virtually left to itself. As a result, an activator "with a memory" is recommended, which is able to save the most recently adjusted state thereof.

It has proven to be beneficial that the control circuit's control output that is attached to an activator is designed in the manner of a push-pull circuit with two transistors connected in series on the output side. These transistors are able to be operated in a number of ways. On the one hand, it is possible to switch through to the output with respectively one of two supply voltages, i.e., for example, $V_{a,s}=0$ V or $V_{a,s}=20$ V. On the other hand, a control circuit can also be set up, wherein the common nodes of both transistors that are being used as the output can capture any number of intermediate values between the two supply voltages, i.e., for example $0\ V \leq V_{a,s} \leq 20\ V$.

The two transistors, which are connected in series on the output side, of the control circuit's control output, which is attached to an activator, should both be high-impedance on the output side in a non-switched-through state in order to give the attached activator the opportunity to not have to allow itself to be influenced by the control circuit; on the contrary, the ink pressure or ink negative pressure currently in effect could then impact the output voltage so that a direct reaction to altered environmental conditions is possible.

In the scope of the actuation according to the invention of an activator, the arrangement should be made such that during the first or second edge, the volume of an ink chamber is increased by means of the activator in question, and during the thereupon immediately following first or second holding time, ink is suctioned into the ink chamber in question.

On the other hand, during the respective other, second or first edge, the volume of the ink chamber in question should be reduced by means of the activator in question, and during the thereupon immediately following second or first holding time, an ink drop is fired out of the associated nozzle.

Special advantages are yielded if a piezo element is used as an activator, which piezo element is in contact with an ink chamber in the region of the ink nozzle in order to influence the volume of the ink chamber. By applying different voltages, such a piezo element can both contract as well as expand so that both loading or fully suctioning the ink chamber with ink can be effectuated with a single, controllable element, as well as pushing out or firing an ink drop.

If the piezo element has conductive coatings on two opposite sides, said conductive coatings can be used as electrodes in order to control the piezo element therewith.

Because the piezo element is not electrically conductive between the two opposite coatings, an electrical charge applied as the result of a voltage that is applied remains constant in the case of the high-impedance output of the control circuit.

The electrical charge applied to the piezo element during a charging phase is dependent on the applied voltage, on the one hand, as well as on the duration of the charging phase, on the other hand.

The invention can be further developed to the effect that, in each case, at least two intervals are selected from the saved waveform and are transferred to the activator.

At least two intervals that are selected and transferred to the activator do not immediately follow each other.

The invention provides that the intervals transferred to the activator are selected from a first or a second holding time.

It is preferred by the invention that, in the case of one, several or all effective drop sizes, in each case no edge is transferred to the activator. Because no saved edge is transferred, but rather only some or all holding phases (in whole or in part), a new target value is specified instead of the predefined edges, which the output voltage can automatically approach.

The invention experiences an advantageous further development to the effect that the saved waveform comprises two or more sequential control pulses, each of which respectively has a first edge, followed by a first holding time, and, after the first holding time, a second, opposite edge, optionally followed by a second holding time. A first control pulse is thereby used primarily for forming an ink drop, and the second control pulse is used for the constitution thereof, in particular its reduction or supplementation, and/or the modification of its movement, in particular the acceleration or deceleration.

Two or more control pulses of the saved waveform can differ from each other, in particular in terms of the slope of the first edge and/or the second edge, and/or in terms of the first holding time and/or the second holding time, and/or in terms of the amplitude of the first and/or second holding time, and/or in terms of the rise time or fall time during the first edge and/or the second edge. As a result, the different requirements of various control pulses can be taken into account.

The quantity of ink flowing into the ink chamber during a holding time in the case of an increased volume of said ink chamber is dependent on the degree of the increase in volume as well as on the duration of the volume increase in question.

On the other hand, the volume of an ink drop fired out during an edge, during which the volume of the ink chamber in question is reduced by means of the activator in question, increases with the slope of the edge in question, in which the volume inside the ink chamber is reduced. Indeed the slope of an edge is explicitly specified only in exceptional cases, thus for example, optionally in the case of an intrinsic drop size, wherein the entire stored waveform is passed on to the print head as a control signal; in most other cases, only holding phases are switched through, wherein the edge slope is then a maximum during a transitional phase, and therefore higher than in the case of the intrinsic drop size. This effect can be so strong that the saved waveform, in the case of complete forwarding to the print head in the absence of an adequate slope, is not able to produce an ink drop at all, rather this is only possible when a higher edge slope is reached as a result of the switching between constant voltage values in accordance with the invention.

In addition, the volume of an ink drop fired out during an edge of a control pulse can increase with the duration of the immediately following effective holding time, because the drop is able develop unhindered in the meantime and thus is able to grow to its full size.

On the other hand, the duration of the effective holding time immediately following an edge is determined by the time interval of a following edge of the control signal.

An edge of a second control pulse, which edge follows before the breaking off of the ink drop discharged during a first control pulse and is (once again) increasing the volume inside the ink chamber, is in a position to reduce the volume of the ink drop, because consequently a larger part of the ink drop is withheld, i.e., an edge, which follows before the drop break off and increases the chamber volume, retracts essentially a part of the drop.

Furthermore, it must be noted that an edge of a second control pulse, which edge follows after the ink drop formed during a first control pulse and is (once again) decreasing the volume inside the ink chamber, is able to increase the volume of the ink drop, namely when consequently an additional quantity of ink is discharged.

After the formation of an ink drop during a first control pulse, an additional quantity of ink can be discharged, when an adequate quantity of ink was suctioned into the ink chamber between the edge that is (once again) increasing the volume inside the ink chamber and a subsequent edge of a second control pulse, which edge is (once again) decreasing the volume inside the ink chamber, and when the edge that is (once again) decreasing the volume inside the ink chamber is sufficiently steep.

It is within the scope of the teaching of the invention that the speed of an ink drop fired out during an edge of a control pulse increases with the amplitude or the swing of the edge of the control pulse. Because with increasing amplitude, a strong pressure can be built up and, therefore, a higher force, the consequence of which is a greater acceleration of the ink to higher speeds.

Because the amplitude of the edge of a control pulse increases with the duration of the actively impressed charging current for the activator, said duration of the charging current can have an impact on the speed of the ink drops. An ink drop that in and of itself is too quick can be adjusted to be slower by shortening the duration of the charging current, i.e., the actively switched-through holding phase, and an ink drop that is too slow can become quicker by increasing the duration of the charging current.

The duration of the actively impressed charging current for the activator should be lower in the case of larger drop sizes than in the case of smaller drop sizes so that the speed of an ink drop fired out during an edge of a control pulse is approximately the same size for all drop sizes.

BRIEF DESCRIPTION OF THE DRAWINGS

Additional features, details, advantages and effects of the invention are yielded from the following description of a preferred exemplary embodiment of the invention as well as based on the drawings which show the following:

FIG. 3 A control signal transferred to a printing system with a partial increase in the region of an edge;

FIG. 4 A view of another embodiment of the invention corresponding to FIG. 3;

DETAILED DESCRIPTION OF THE PREFERRED EMBODIMENTS

Figure 1:
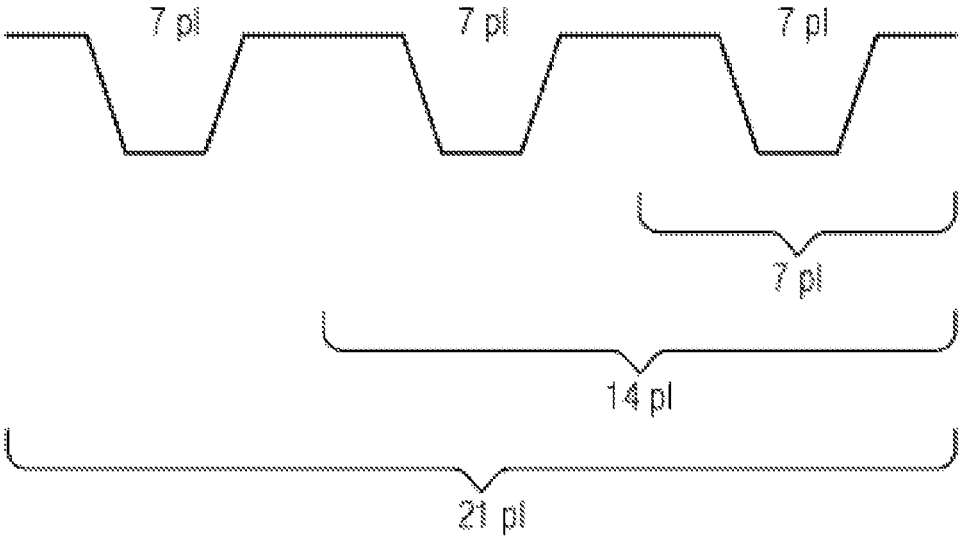
Fig.1 Prior Art
FIG. 1 A waveform for actuating a nozzle of a print head in accordance with the prior art.

FIG. 1 depicts the conventional approach in the prior art for modifying the gray scale of a pixel, namely by correspondingly replicating the number of control pulses in the region of the pixel in question. If, instead of a single control pulse, two or three (as depicted in FIG. 1) control pulses are produced and transmitted to the printing system in question, many times the amount of an ink jet drop reaches the pixel in question to be printed. If a single ink drop has a size of 7 pl (picoliters), then two ink drops have 14 pl, and three ink drops have 21 pl. Depending on how great the intervals are between individual control pulses, either individual drops are produced that are first superimposed on or added to the substrate to be printed on, or the ink drops already combine in the region of the nozzle or during flight and then arrive on the substrate as a single, large drop. Reducing the ink drop size (to less than 7 pl for example) is not possible by these means, however, and creating drops of intermediate sizes, i.e., drops with a volume of 10 pl for example, is also not possible herewith.

Figure 2:
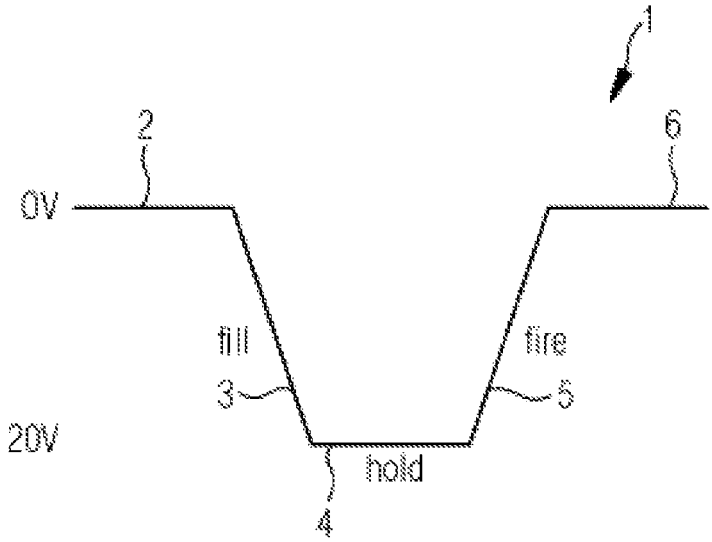
FIG. 2 A stored, common waveform according to the invention for generating control signals for a digital printing system.

FIG. 2 shows what a waveform 1 used by the invention for the production of a ink drops looks like.

It shows the inactive starting position 2 at voltage level 0 V, to which the level also returns again at the end of the saved pulse sequence. This is preferably an extreme value of the voltage level that is available. A voltage level of −20 V, which in FIG. 2 constitutes the lowest voltage level, represents the other extreme value in the present example.

As shown in FIG. 2, the saved waveform 1 after the starting value 2 has a first edge 3, while the volume inside the ink chamber of the printing system in question is increasing, followed by a first holding time 4, during which the ink has an opportunity, due to the negative pressure in the expanded ink chamber, to flow into said ink chamber. This is then followed by a second edge 5, during which the volume of the ink chamber is reduced, followed by a second waiting time 6, during which a drop from the ink chamber is fired through the nozzle in the direction of the substrate to be printed on. The entire sequence, consisting of the initial waiting time 2, first edge 3, first holding time 4, second flank 5 and second holding time 6 consists of a sequence duration T of 10 μs in total, for example. One fifth of the entire sequence duration T is accounted for in each case by the initial waiting time 2, the first edge 3, the first holding time 4, the second edge 5 and the second holding time 6, i.e., then 2 μs in each case in the present example.

Figure 5:
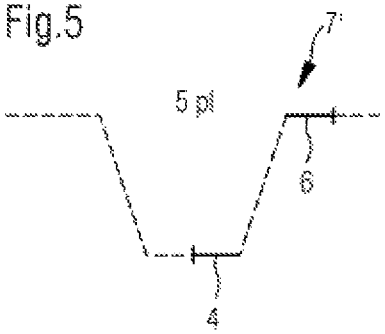
FIG. 5 A control signal transferred to a printing system for the production of an ink drop with a volume of 5 picoliters (pl)
Figure 5A:
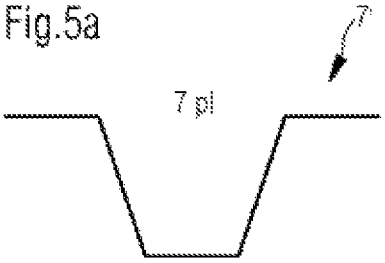
FIG. 5*a* A control signal transferred to a printing system for the production of an ink drop with a volume of 7 pl.

FIG. 5*a* shows an example that, in the case of a complete run-through of this saved waveform 2 as a control sequence, a drop with a size 7 pl is produced.

FIGS. 3 and 4 illustrate two possibilities of how the saved waveform 2 can be converted into a control signal 7, 7' for a printing system.

In this context, the output or the output stage of the control amplifier is designed to be identical in both cases, for example, with two transistors that are interconnected such that their collector-emitter paths are connected in series. Both transistors can then be switched on anti-cyclically, i.e., in such a way that one of the two always conducts, but the other not does not. Then potential is applied to the connecting node between the two transistors depending on the switching state either at the upper potential (in this case 0 V) or at the lower potential (in this case −20 V).

Therefore, such an output can be used to simply switch between two voltage levels, as can be seen in FIG. 3. The slope of the edges 8, 9 of the control signal voltage level is then not predetermined, rather conforms to the circumstances of the printing system, in particular the capacity thereof, as well as, on the other hand, to the available energy or the maximum current available to the amplifier output. However, the progression of the edges 8, 9 is relatively smooth, as FIG. 3*a* shows.

The embodiment according to FIG. 4 makes use of the fact that with suitable actuation of two transistors of an amplified output that are connected in series, every intermediate value between the two input voltages (in this case then 0 V, on the one hand, and −20 V, on the other) can be produced. A very precise actuation of the amplifier output would be possible, for example by a feedback of the output voltage and a comparison with a predetermined target value, wherein then the identity of the two voltages (as the case may be, multiplied by a factor which can be realized by using a voltage divider in the actual value determination on the amplifier output) can be ensured by means of a regulator. In such a case, a saved waveform 2 can be supplied as a variable of time to the target value input of such an amplifier, and said amplifier then makes exactly this voltage (or a multiple thereof) available to its output as a control signal for a printing system. On the other hand, in order to be able to supply a waveform stored i.e., in the form of digital values as an analog target value to such an amplifier stage, a digital-to-analog conversion of the saved waveform 1 is required. Because in the process the starting value of a digital-to-analog converter used for this can only adjust step by step (the saved digital values of the waveform 1 are indeed restricted to a finite number of bits) one sees a plurality of small steps 10, as shown in FIG. 4, in the edges 8', 9' of the output signal of an amplifier operated like this or in the control signal 7' generated thereby.

According to the current prior art, these steps 10 are irrelevant for the printing process, or were not taken into consideration or overlooked. However, the following can be established. The steps cause micro-vibrations in the piezo element, which even though they are partially damped by the ink, despite this they ultimately affect the drop formation to the extent that there are presumed ideal values for the waveform of an individual drop, individually for every different print head. These ideal values for the edges and holding times were defined as the resonance of the print head, because the drop formation turned out to be ideal at these values. Shorter or longer times led to a deterioration of the drop formation, and namely most likely because the ink damped the micro-vibrations too little or too much and thus has an unfavorable effect on the drop. However, it was already ascertained in Patent Application WO 2017/009 705 A2 that a considerable shortening of the actuation period with respect to the resonance period positively influences the drop formation by more than 1½ times, and probably because, as of certain shortening time of the edge time, the vibrations are reduced so much that a favorable or even better effect on drop formation in relation to the presumed ideal value is again obtained, in particular as a result of a reduction of the number of steps and therefore of the quantity and duration of the vibrations during drop formation.

The invention makes use of this advantage in the following, as illustrated FIGS. 5 to 5*f*, which show the control signal 7', as it effectively arrives at a printing system. The time axis should always be thought of as on the right and the time-dependent amplitude of the control signal 7' towards the top. In this case, a solid line means that at the respective points in time, the voltage of the control signal 7' is explicitly specified and is transferred to the printing system in question, while a dashed line means that at these points in time the control signal is not specified. At these points in time either no control signal whatsoever is produced, or said signal is not transferred to the activator of the printing system. This could take place for example due to an interruption of the supply line between the control stage and activator or due to the blocking of both transistors of the output stage of the amplifier in question. It is also possible in this case to disconnect the control loop or unclamp or separate the target value of the control circuit.

As one can see from FIG. 5, such a shortening of the control signal 7' on the second half of the saved waveform 1 in conjunction with a shortening of the second holding time 6 leads, for example, to the ink chamber being filled less, on the one hand, and consequently to the generated ink drop also being smaller than normal, i.e., having only a volume of 5 pl for example. This is thus achieved in that only the second half of the first holding time 4 and the first half of the second holding time 6 are switched through to the activator.

Figure 5B:
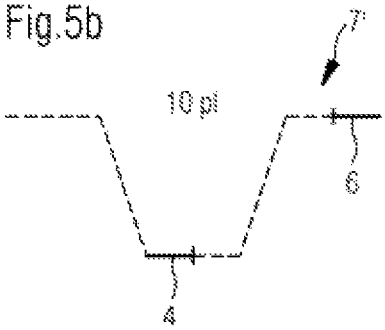
FIG. 5*b* A control signal transferred to a printing system for the production of an ink drop with a volume of 10 pl.

If according to FIG. 5*b*, for example only the first half of the first holding time 4 and the second half of the second holding time 6 are switched through to the activator, then a drop with a size of 10 pl is obtained. This is presumably due to the fact that there is a long interval between the two predetermined time periods, during which the ink has time to flow into the ink chamber.

Figure 5C:
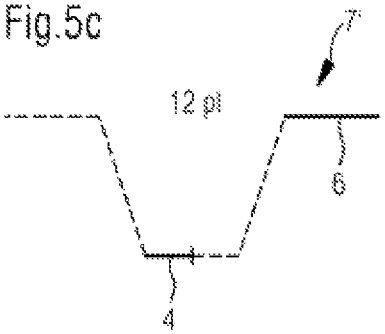
FIG. 5*c* A control signal transferred to a printing system for the production of an ink drop with a volume of 12 pl.

An even larger drop with a volume of approximately 12 pl is obtained according to FIG. 5*c*, for example, in that only the first half of the first holding time 4 is transmitted to the printing system, but the entire second holding time 6. As a result, the drop has a long time to form outside the nozzle, because the pressure within the ink chamber is maintained for a long time.

If both holding times 4, 6 of the saved wave function 1 are transferred completely to the activator of the printing system, and not, on the other hand, the edges 3, 5, then one obtains ink drops with a size of approx. 14 pl. In this case, ink flows into the ink chamber, on the one hand, at least during the entire first holding time 4 ink; however, this ink flow is not interrupted by a second edge 5, because the second edge 5 is suppressed. As a result, even more ink can flow into the ink chamber than is the case in FIG. 5*a*.

Figure 5D:
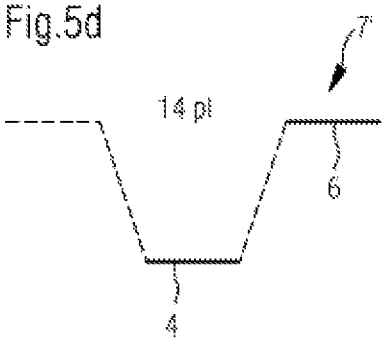
FIG. 5*d* A control signal transferred to a printing system for the production of an ink drop with a volume of 14 pl.
Figure 5E:
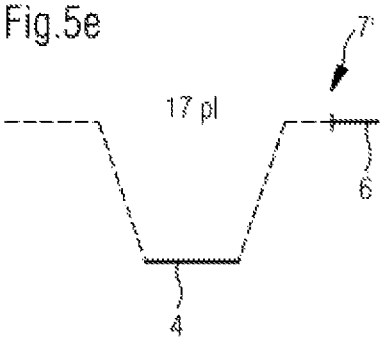
FIG. 5*e* A control signal transferred to a printing system for the production of an ink drop with a volume of 17 pl.
Figure 5F:
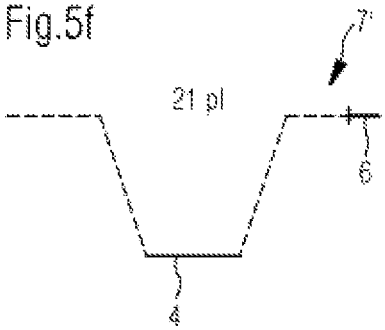
FIG. 5*f* A control signal transferred to a printing system for the production of an ink drop with a volume of 21 pl.

If, after actuation of a first holding time 4, one waits with the second holding time 6 even longer than that corresponding to the second edge 5, then an even larger quantity of ink can flow into the ink chamber, and one obtains a drop size of 17 pl according to FIG. 5*e* and a drop size of even 21 pl according to FIG. 5*f* (in this case, the wait with the second actuation phase is even longer as compared to FIG. 5*e*).

Figure 6:
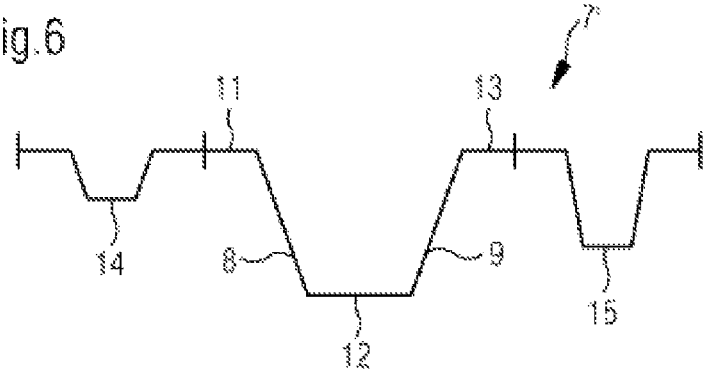
FIG. 6 A further embodiment of the invention in a depiction corresponding to FIG. 2.
Figure 7:
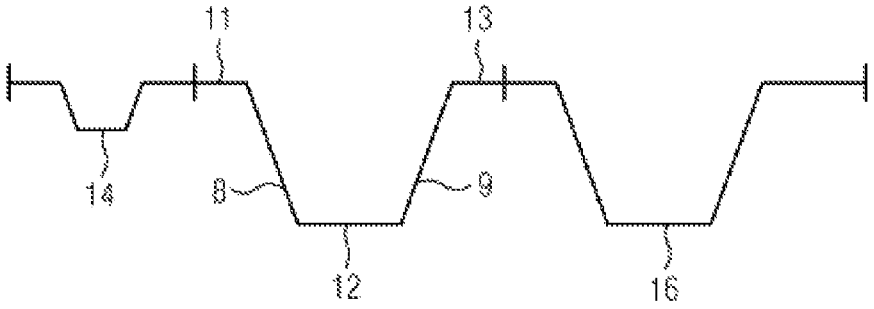
FIG. 7 An again modified embodiment of the invention in a depiction according to FIG. 6.
Figure 8:
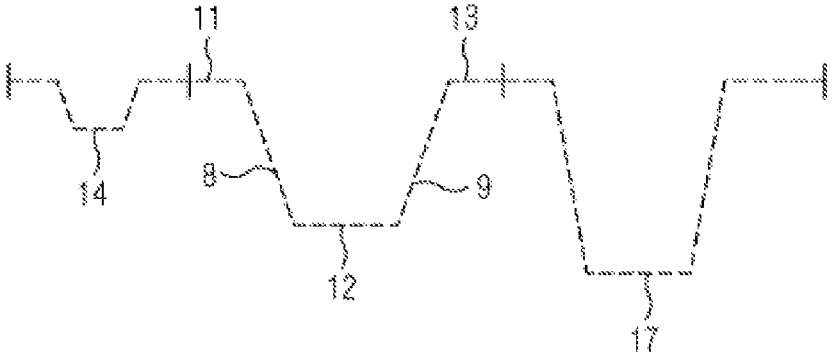
FIG. 8 An embodiment of the invention that was again modified similar to the depiction in FIG. 6.

FIGS. 6 to 8 show other possibilities of how the control signal 7' can be optimized further. In the process, the part of the control signal that can modified according to FIGS. 5 to 5*f*, i.e., the initial waiting time 11, the first edge 8, the first holding time 12, the second edge 9 and the second holding time 13, can always be found in the center of the depicted control sequence.

For example, the initial waiting time 11 can be preceded by a small pre-fire pulse 14, which has an increasing effect on the drop volume. As a result, for example a vibration of the system can be actuated, which can cause especially steep edges.

As an alternative to this or in addition, it is also possible to produce a counter pulse 15 with reduced amplitude after the modifiable control pulse, which counter pulse has a reducing effect on the drop quantity. As a result, the breaking-off of the drop can be initiated prematurely.

FIG. 7 shows a wave with a pre-pulse 14 as well as two waveforms 1 for the production of a drop in each case, wherein the two drops have the same size such that two or more equally sized ink drops can be allocated in this way to a pixel. A separate drop is preferably not generated by the pre-pulse, rather as the case may be an immediately following drop is influenced.

Furthermore, FIG. 8 is supposed to show that the first, controllable pulse with the initial waiting time 11, first edge 8, first holding time 12, second edge 9 and second holding time 13 can also be followed by at least one further, preferably controllable print pulse 17, so that two or more ink drops of a different size can also be allocated to a pixel.

If, for example, two or more sequences according to FIGS. 5*a* to 5*f* are transmitted in succession, then an ink quantity of 42 pl can be put on paper, or on the substrate, in a relatively short time interval of only 20 μs. Double the time would be required for this according to the conventional method in FIG. 1.

If one applies the possibilities described in FIGS. 5 and 5*a* to 5*f* as an example to three sequential drop pulses, which are allocated to a pixel, then it is possible to therewith produce in an ideal case (including the zero pulse) three differently sized drops each with eight possible drop sizes, i.e., there are a total of 8*8*8=512 different gray scales or brightness levels.

Thus, the invention allows one to obtain from one small nozzle with a nominal drop size for example of 7 pl, lots of different drop sizes, e.g., in a range from 5 pl or less to 50 pl or more.

In the process, even more different intermediate sizes of drops can be generated and consequently lots of gray scales and brightness levels.

Furthermore, the size of the pre-fire pulses or counter pulses can also be influenced in a corresponding manner.

Consequently, because of the present invention, one obtains all required drop sizes from one and the same nozzle in order to be able to print with a low physical resolution that is comparable to offset printing and at the same time produce high visual printing quality. In other words, a firing frequency of only 12 kHz is required for example for an image being printed with a resolution von 300×300 dpi despite a high printing speed of e.g., 1 m/sec.

In addition, with the use of the method according to the invention, the requirements for software and/or hardware and/or mechanical engineering are considerably lower than is the case in the previously known prior art. The invention also makes it substantially easier to manufacture print heads with a low nozzle resolution or nozzle density as well as large nozzles.

As one can see in FIGS. 9*a* to 9*e*, the method according to the invention offers yet another advantage, because the drop speed can also be influenced with the selection of suitable portions of the saved waveform.

Figure 9A:
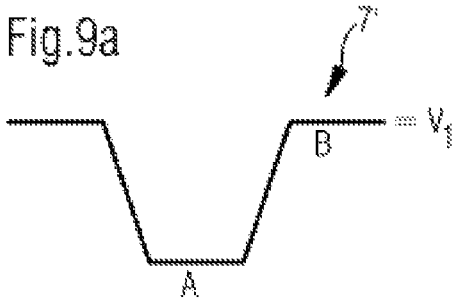
FIG. 9*a* A stored waveform as a control signal completely transferred to a printing system for the production an intrinsic ink drop with a speed of $v_1$.

To begin with, the complete signal for forming an intrinsic drop according to FIG. 9*a* should be regarded, which corresponds to FIG. 5*a* and thus supplies a drop with a size of 7 pl. The speed of said "intrinsic drop" with a size of 7 pl should be designated as $v_1$.

Figure 9B:
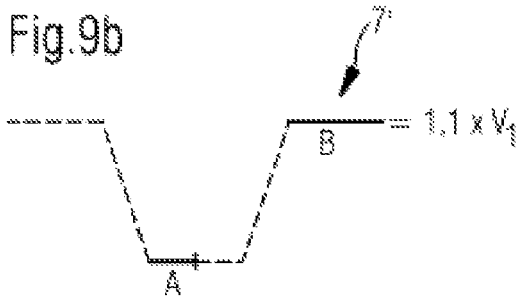
FIG. 9*b* A further control signal transferred to a printing system in the form of two portions of the saved waveform for the production of an ink drop with a speed of $1.1*v_1$.

Now if only the portions A and B according to FIG. 9*b* are transferred to the printer unit, this corresponds to the approach according to FIG. 5*c*; in other words, an ink drop with a size of 12 pl is produced, wherein the portion A corresponds to the portion 4 in FIG. 5*c*, while the portion B is equivalent to the portion 6 in FIG. 5*c*. It turns out that, in this case, the drop speed is slightly increased, specifically it is now $v=1.1*v_1$.

Figure 9C:
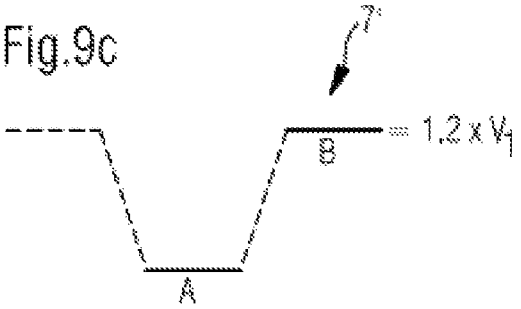
FIG. 9*c* An again modified control signal transferred to a printing system in the form of two other portions of the saved waveform for the purpose of producing an ink drop with a speed of $1.2*v_1$.

In a similar way, one can actuate the printer unit as in FIG. 9*c* or 5*d*. Then one obtains an ink drop with a size of 14 pl with a drop speed of $v=1.1*v_1$.

Figure 9D:
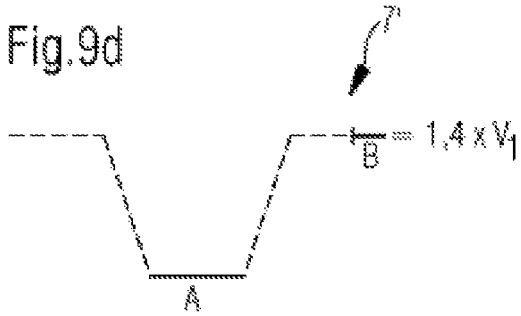
FIG. 9*d* An again modified control signal transferred to a printing system, comprising two once again otherwise selected portions of the saved waveform for the purpose of producing an ink drop with a speed of $1.4*v_1$.

If one actuates the printer unit as in FIG. 9*d* or 5*f*, an ink drop with a size of 21 pl with a drop speed of $v=1.4*v_1$ is obtained in that way.

Figure 9E:
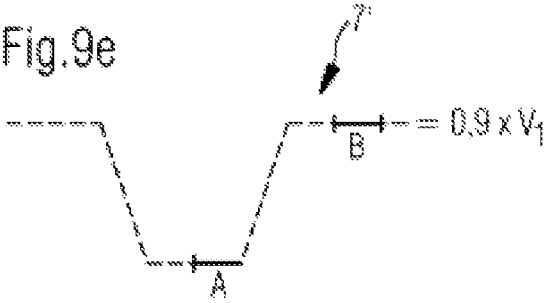
FIG. 9*e* An again modified control signal transferred to a printing system, comprising two other portions of the saved waveform, whereupon the ink drop produced has a speed of $0.9*v_1$.

On the other hand, an actuation according to FIG. 9*e* shows that the intrinsic drop speed $v_1$ can also be fallen short of, specifically by an actuation that corresponds approximately to a mixture of FIGS. 5 and 5*b*.

The inventor discovered that a combination of two or more control pulses 18, 19 produces additional adjustment parameters, which makes it possible to vary the two variables of drop size and drop speed in a different way.

Consequently, several different approaches for producing an ink drop of a desired size can be used to select the respective mask for the portions of the common waveform to forward to the printer unit, which portions produce an identical or almost identical drop speed.

Figure 10:
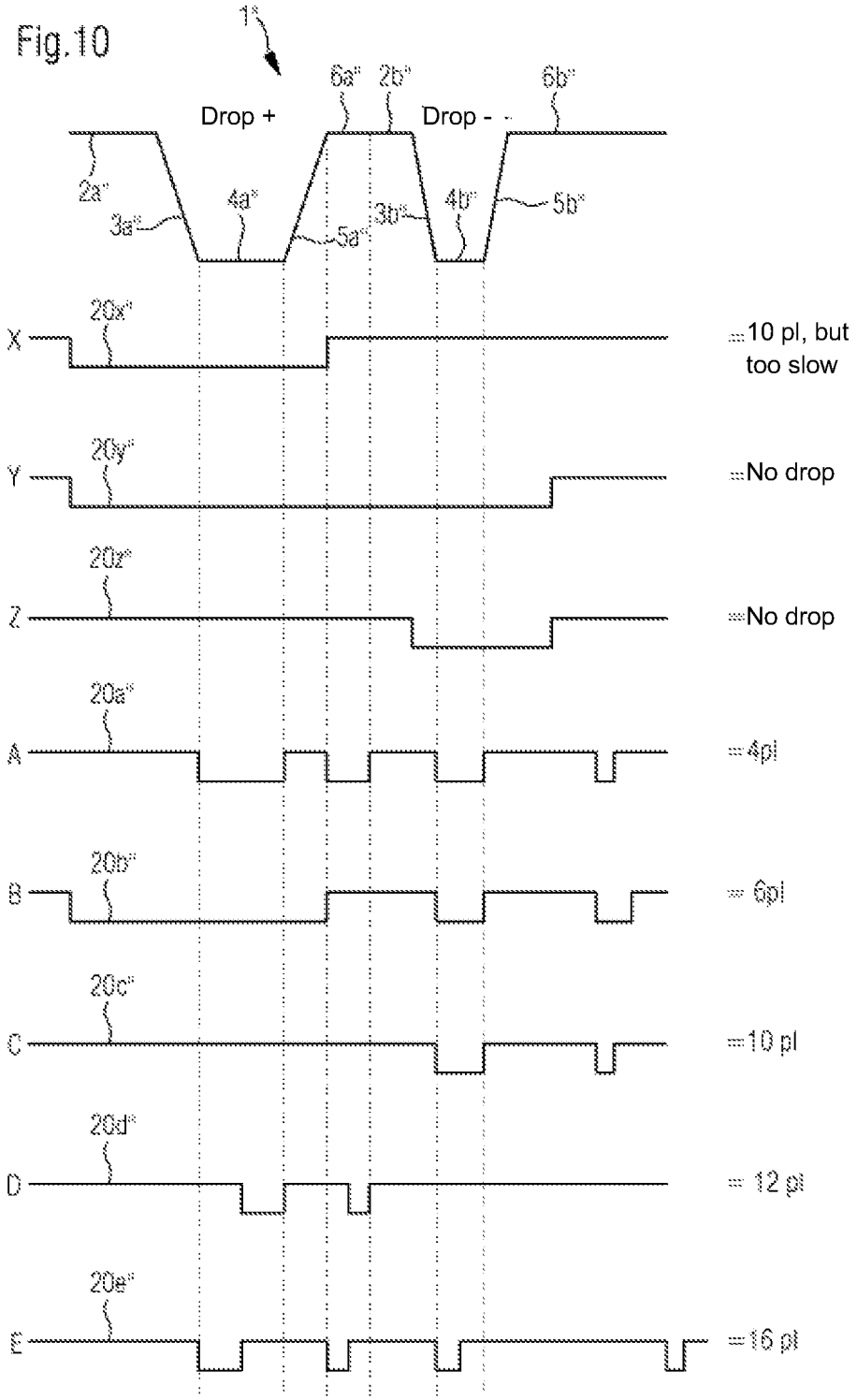
FIG. 10 An exemplary compilation of a plurality of time signals which illustrate the selection and composition of respectively different portions of the saved waveform for different control signals for certain ink drop sizes.

The result is depicted in FIG. 10:

There one can see a common stored waveform 1" with two chronologically sequential control pulses 18, 19 for all ink drops of different sizes.

As one can see, the first control pulse 18 makes use of a greater timeframe than the following, second control pulse 19. This is because the slope of edge 3*a*" of the first control pulse 18 has a smaller slope than the corresponding edge 3*b*" of the second control pulse 19, and the edge Sa" is also flatter than the edge 5*b*". Furthermore, the holding time 4*a*" of the first control pulse 18 longer than the holding time 4*b*" of the second control pulse 19.

In addition, the level of the holding times 4*a*" and 4*b*" could also be a different size, however, which is not realized in the embodiment according to FIG. 10.

The parameters of the stored waveform 1" are selected in such a way that ink drops of different sizes, but the same speed, can be produced with this single waveform 1".

Depicted beneath the saved waveform 1" are different control signals 20*a*" to 20*z*", which are basically inverted, i.e., in each case, only the portions of the waveform 1" during the low phases of the control signal 20*a*" to 20*z*" in question are switched through to the printer unit.

However, it shows that completely switching through both control pulses 18, 19 with the control signal 20*y*" does not supply any ink drops at all. This is due to the fact that the slope of the edges 3*a*" and 5*a*" of the first control pulse 18 is relatively small; the ink drop in the process of being thereby formed is relatively slow and moderate and is completely withdrawn again by the following second control pulse 19.

In the case of the control signal 20$x$", the second control pulse 19 is not switched through, and one obtains an ink drop with a size of 10 pl, which is relatively slow, however, just because of the small slope of edges 3$a$" and 5$a$".

On the other hand, the control signal 20$z$" switches only the second control pulse 19 further to the attached printer unit, while the first control pulse 18 is suppressed. Even though the edges 3$b$" and 5$b$" are somewhat steeper than the edges 3$a$" and 5$a$" of the first control pulse 18, the holding phase 4$b$" is too short for an ink drop with an adequate size to be able to form and additionally also have a sufficient pulse to be able to release from the printer unit; again no ink drop whatsoever is formed.

It turns out, however, that the special control signals 20$a$" to 20$e$" supply ink drops with different sizes, which have the same drop speed however:

Control signal 20$c$" comes the closest to the sole "intrinsic" ink drop, which is generated in the case of the control signal 20$x$" by the control pulse 18; said control signal 20$c$" likewise supplies an ink drop with a volume of 10 pl, which is significantly faster, however, than that of the ink drop produced with the control signal 20$x$". The control signal 20$x$" switches through only the holding phase 4$b$" of the second control pulse 19 as well as a temporally differentiated part of the second holding phase 6$b$" of this second control pulse 19. In contrast to the control signal 20$z$", however, the edges 3$b$" and 5$b$" are not predetermined in this respect, rather there is an abrupt switch from high-impedance to the respective voltage level 4$b$" or 6$b$", which results in a maximum slope of the actual adjacent edges, which facilitates a release of the drop. In addition to this, the immediately adjoining portion 6$b$" is not switched through, rather a waiting time elapses first, during which the ink chamber is able to fill. Because of the steep edges, the ink drop in the case of control signal 20$c$" is released from the print head under relatively high pressure and therefore obtains a relatively high speed v.

Starting from the control signal 20$c$", which supplies an ink drop with the volume of 10 pl with selective switching-through of parts of the second control pulse 19, the control signal 20$d$" results in a comparable approach related to the first control pulse 18; because of the selective switching-through of parts of same, an ink drop is produced with a volume of 12 pl, but with the same speed v.

The control signal 20$e$" constitutes a slightly modified combination of the two control signals 20$c$" and 20$d$", wherein, respectively a portion of the first holding phase 4$a$" and the second holding phase 6$a$" of the first control pulse 18 is switched through, along with respectively a portion of the first holding phase 4$b$" and the second holding phase 6$b$" of the second control pulse 19. Because of the long waiting time before the switched-through portion 6$b$", it is possible for a second ink drop to be launched, presumably even before the breaking-off of the ink drop created during the first control pulse 18, i.e., these two ink drops are either originally interconnected or combine in flight and thus hit the substrate to be printed on as a single drop. Using this method, one obtains a drop with a volume of 16 pl; the speed v is equal to the speed produced by the control signals 20$c$" and 20$d$".

Starting from the control signal 20$x$" that was discarded originally because of the ink drop that was too slow, however with a steeper second edge (at 5$a$"), a sufficiently fast ink drop is created, which, however, is not increased by means of two switched-through portions 4$b$", 6$b$" of the second control pulse 19, but is reduced. Here, the overall third edge (at 3$b$") again occurs relatively shortly after the first created ink drop, however not as quickly as is the case with control signal 20$y$". After a type of counter pulse, therefore the parts of the second control pulse 19 cannot completely retract the created ink drop, but diminish it in terms of its volume. The resulting ink drop has a volume of 6 pl with the same speed v.

The control signal 20$a$" results in another reduction of the ink drop volume. This is achieved in that only two portions 4$a$", 6$a$" that are separated from each other are switched through by the first control pulse. The result of this is that the first two edges (at 3$a$" and 5$a$") are steeper and thus the ink drop obtains a comparable or even greater initial speed; at the same time, however, because of the shortening of the ink loading phase on the plateau of the holding phase 4$a$", less ink is sucked into the ink chamber, and therefore only a smaller ink drop forms. Then, because of the partially switched-through second control pulse 19, even a partial volume is again withdrawn therefrom, in the manner of a counter pulse. One eventually obtains an ink drop of only 4 pl, but because of the high initial speed once again with the speed v.

As one can see, it is thus possible to produce ink drops with the sizes of 4 pl, 6 pl, 10 pl, 12 pl and 16 pl, all of which have the same drop speed v, from the single, stored waveform 1" by masking and switching through specific portions by means of the control signals 20$a$" to 20$e$".

FIGS. 11$a$ to 11$d$ depict another possibility for influencing the drop size and/or drop speed, which can be applied in particular with the use of piezo elements:

FIG. 11$a$ depicts a stored waveform 1, which corresponds to the waveform 1 according to FIG. 2. It shows the holding phases 2, 4, 6 and the two edges 3, 5. The amplitude is 20 V respectively on each edge 3, 5.

FIGS. 11$b$ to 11$d$ depict how different portions 4, 6 are switched through to the attached printer unit from this uniform waveform 1 by means of different control signals.

According to FIG. 11$b$, the holding phases 4 and 6 are switched through completely in each case. The result is that the output transistors of the control stage, which by their very nature can drive only a limited current, have enough time to be able to completely charge the electrodes on the two opposite sides of the piezo element to the voltage 0 V, on the one hand, and then to the voltage of 20 V on the other hand. The progression of the voltage 21 between the two electrodes of the piezo element follows the predetermined waveform 1 almost exactly, as FIG. 11$b$ clearly shows.

In the case of FIG. 11$c$ in contrast, the holding phase 4 is not switched through completely, but only a very small portion, for example, for a duration of approximately one quarter or one fifth of the entire holding phase 4. This is so short that the switched-through duration between the two high-impedance phases of the output stage of the control circuit is not adequate to bring sufficient charge carriers to the electrodes of the piezo element, which are required to reduce the voltage 21 between those from 20 V to begin with and 0 V. In fact the swing or the amplitude is reduced in the region of the edge 3, and the voltage 21 drops for example only by approx. 16 V, i.e., from 20 V to 4 V. Because the subsequently switched-through holding phase 6, on the other hand, is sufficiently long, the voltage 21 subsequently makes its way again completely to 20 V.

However, because the piezo element does not execute the full swing, but only a swing of 4/5 of the maximum amplitude for example, the chamber volume increases only to a correspondingly reduced degree. Less ink is sucked in, and, therefore, only an ink drop with a lower volume can also be discharged during the second edge, for example with a value that is reduced to approximately ⅘ of the volume according to FIG. 11*b*.

Figure 11A:
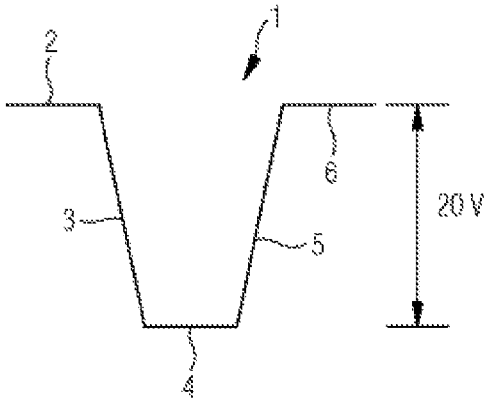
FIG. 11*a* A saved waveform for a control pulse with an amplitude of 20 V.
Figure 11B:
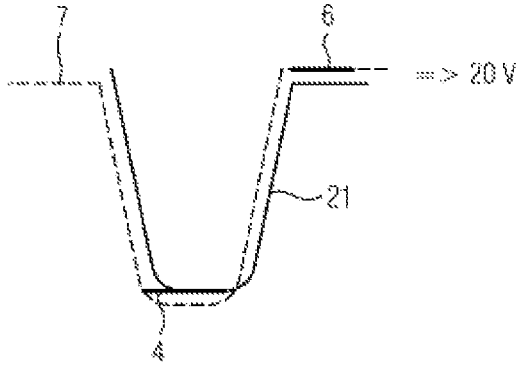
FIG. 11*b* A control pulse partially transferred to a printing system, wherein, however, the holding phases are transferred completely so that the amplitude of 20 V is maintained.
Figure 11C:
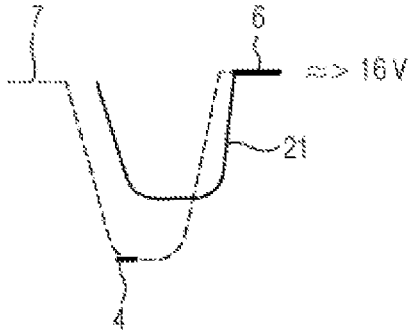
FIG. 11*c* A control pulse that is again partially transferred to a printing system, wherein, however, the first holding phase is not transferred completely so that the amplitude in the region of both edges is reduced from 20 V to 16 V.
Figure 11D:
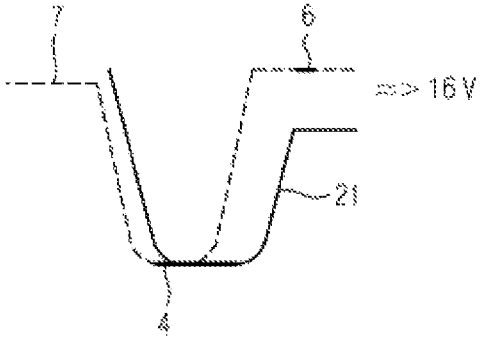
FIG. 11*d* A control pulse that is again partially transferred to a printing system, wherein now the second holding phase is not completely transferred so that the amplitude in the region of the second edge is reduced from 20 V to 16 V.

FIG. 11*d* shows another approach which has a similar effect however: In this case, the switching-through of the holding phase 4 is not substantially reduced, rather the switching-through of the holding phase 6. Therefore, the voltage 21 between the electrodes of the piezo element initially follows the edge 3 of the saved waveform 1 almost exactly, i.e., also with an amplitude swing of 20 V. Therefore, the maximum possible ink quantity is sucked into the ink chamber.

However, the great reduction of the switched-through holding phase 6 leads to the voltage 21 in the region of the edge 5 not having an adequate opportunity to increase again up to the full value of 20 V. Based on the electrode capacities to be recharged, only a voltage 21 of approximately 16 V can be achieved with the applied charge quantity. Again, only a smaller quantity of ink is discharged from the printer unit, in the present example again only in an order of magnitude of ⅘ of the maximum value according to FIG. 11*b*.

A further possibility for influencing the amplitudes of a control signal consists of providing, along with the ground potential of 0 V, not just one single supply voltage, for example 20 V, but several, i.e., for example 16 V and 20 V, between which it is possible to switch as needed, for example between each of the two control pulses 18, 19.

LIST OF REFERENCE NUMBERS

1 Waveform
2 Initial waiting time
3 First edge
4 First holding time
5 Second edge
6 Second holding time
7 Control signal
8 Edge
9 Edge
10 Step
11 Waiting time
12 First holding time
13 Second holding time
14 Pre-fire pulse
15 Counter pulse
16 After pulse
17 Successive print pulse
18 First control pulse
19 Second control pulse
20 Control signal
21 Voltage

The invention claimed is:

1. A printing method for a digital printing device for the production of ink drops of different sizes, comprising a print head having a plurality of printing systems and comprising at least one control apparatus for feeding control signals to the printing systems for the production of ink drops, wherein each printing system has a nozzle, at least one ink chamber and an activator, which is associated with the at least one ink chamber, for the discharge of ink drops from the ink chamber in question via the nozzle in question onto a substrate to be printed on, as a response to a control signal, characterized in that, in the control apparatus, only a single waveform (1) for the control signal (7, 7') having a specified time curve is stored for ink drops of all sizes, comprising at least one printing pulse (1), this printing pulse comprising: (i) optionally an initial waiting time (2), (ii) a first edge (3), followed by (iii) a first holding time (4), and, after the first holding time (4), (iv) a second, opposite edge (5), (v) optionally followed by a second holding time (6), wherein the size and/or speed of ink drops is varied by virtue of the fact that, at most for a single, intrinsic drop size, the entire stored waveform (1) is transferred as a control signal (7, 7') to the activator in question, while for all other, effective drop sizes, only a portion of the stored printing pulse (1) is transferred to the regarding activator, namely one or more selected portions of the initial waiting time (2), the first edge (3), the first holding time (4), the second opposite edge (5), and the second holding time (6), while one or more other portions of this stored, printing pulse (1) are not supplied to the regarding activator as part of the control signal (7, 7').

2. The printing method according to claim 1, characterized in that a drive circuit with a switched output is used or a drive circuit with a controlled output or with a regulated output.

3. The printing method according to claim 1, characterized in that the control circuit is high-impedance during portions of the saved waveform (1) that are not switched-through on the control output thereof that is connected to an activator.

4. The printing method according to claim 3, characterized in that the control circuit's control output that is attached to an activator is designed in the manner of a push-pull circuit with two transistors connected in series on the output side.

5. The printing method according to claim 4, characterized in that the two transistors, which are connected in series on the output side, of the control circuit's control output, which is attached to a piezo element, are both high-impedance on the output side in a non-switched-through state.

6. The printing method according to claim 2, characterized in that during the first or second edge (3, 5), the volume of an ink chamber is increased by means of the activator in question, and during the thereupon immediately following first or second holding time (4, 6), ink is suctioned into the ink chamber in question.

7. The printing method according to claim 6, characterized in that during the respective other, second or first edge (5, 3), the volume of the ink chamber in question is reduced by means of the activator in question, and during the thereupon immediately following second or first holding time (6, 4), an ink drop is fired out of the associated nozzle.

8. The printing method according to claim 2, characterized in that a piezo element is used as an activator, which piezo element is in contact with an ink chamber in the region of an ink nozzle in order to influence the volume of the ink chamber.

9. The printing method according to claim 8, characterized in that the piezo element has conductive coatings on two opposite sides, which can be used as electrodes.

10. The printing method according to claim 9, characterized in that the piezo element is not electrically conductive between the two opposite coatings, so that an electrical charge applied as the result of a voltage that is applied remains constant in the case of the high-impedance output of the control circuit.

11. The printing method according to claim 9, characterized in that the electrical charge applied to the piezo element during a charging phase is dependent on the applied voltage as well as on the duration of the charging phase.

12. The printing method according to claim 2, characterized in that, in each case, at least two intervals are selected from the saved waveform (1) and are transferred to the activator.

13. The printing method according to claim 12, characterized in that at least two intervals that are selected and transferred to the activator do not immediately follow each other.

14. The printing method according to claim 2, characterized in that the intervals transferred to the activator are selected from a first or a second holding time (4, 6).

15. The printing method according to claim 2, characterized in that, in the case of one, several or all effective drop sizes, no edge (3, 5) is transferred to the activator.

16. The printing method according to claim 2, characterized in that the saved waveform (1) comprises two or more sequential control pulses, each of which respectively has a first edge (3), followed by a first holding time (4), and, after the first holding time (4), a second, opposite edge (5), optionally followed by a second holding time (6).

17. The printing method according to claim 16, characterized in that two or more control pulses of the saved waveform (1) differ from each other in terms of the slope of the first edge (3) and/or the second edge (5), and/or in terms of the first holding time (4) and/or the second holding time (6), and/or in terms of the amplitude of the first and/or second holding time (4,6), and/or in terms of the rise time or fall time during the first edge (3) and/or the second edge (5).

18. The printing method according to claim 16, characterized in that an edge of a second control pulse, which edge follows before the breaking off of the ink drop discharged during a first control pulse and is (once again) increasing the volume inside the ink chamber, reduces the volume of the ink drop, because consequently a larger part of the ink drop is withheld.

19. The printing method according to claim 16, characterized in that an edge of a second control pulse, which edge follows after the ink drop formed during a first control pulse and is (once again) decreasing the volume inside the ink chamber, increases the volume of the ink drop, when consequently an additional quantity of ink is discharged.

20. The printing method according to claim 16, characterized in that after the ink drop formed during a first control pulse, an additional quantity of ink is discharged, when an adequate quantity of ink was suctioned into the ink chamber between the edge that is (once again) increasing the volume inside the ink chamber and a subsequent edge of a second control pulse, which edge is (once again) decreasing the volume inside the ink chamber, and when the edge that is (once again) decreasing the volume inside the ink chamber is sufficiently steep.

21. The printing method according to claim 2, characterized in that the quantity of ink flowing into the ink chamber during a holding time in the case of an increased volume of said ink chamber is dependent on the increase in volume, and/or on the duration of the volume increase in question.

22. The printing method according to claim 2, characterized in that the volume of an ink drop fired out during an edge (5, 3), during which the volume of the ink chamber in question is reduced by means of the activator in question, increases with the slope of the edge (5, 3) in question, in which the volume inside the ink chamber is reduced.

23. The printing method according to claim 2, characterized in that the volume of an ink drop fired out during an edge (5, 3) of a control pulse increases with the duration of the immediately following effective holding time.

24. The printing method according to claim 2, characterized in that the duration of the effective holding time immediately following an edge is determined by the time interval of a following edge of the control signal.

25. The printing method according to claim 2, characterized in that the speed of an ink drop fired out during an edge (5, 3) of a control pulse increases with the amplitude of the edge (5, 3) of the control pulse.

26. The printing method according to claim 25, characterized in that the amplitude of the edge (5, 3) of a control pulse increases with the duration of the actively impressed charging current for the activator.

27. The printing method according to claim 26, characterized in that the duration of the actively impressed charging current for the activator is lower in the case of larger drop sizes than in the case of smaller drop sizes.

28. The printing method according to claim 2, characterized in that the speed of an ink drop fired out during an edge (5, 3) of a control pulse is kept constant for all drop sizes.

29. The printing method according to claim 1 wherein the activator comprises a piezoelectric activator.

* * * * *